United States Patent [19]

Boik

[11] Patent Number: 4,557,393

[45] Date of Patent: Dec. 10, 1985

[54] SNAP-ON CAP WITH TETHERING STRAP

[75] Inventor: Elmer Boik, Lombard, Ill.

[73] Assignee: Continental White Cap, Inc., Northbrook, Ill.

[21] Appl. No.: 601,210

[22] Filed: Apr. 17, 1984

[51] Int. Cl.[4] ..... B65D 49/12

[52] U.S. Cl. ..... 215/253; 215/252; 215/258

[58] Field of Search ..... 215/250, 252, 253, 258, 215/317, 224

[56] References Cited

U.S. PATENT DOCUMENTS 3,441,161 4/1969 Van Baarn ..... 215/252 X 3,904,062 9/1975 Grussen ..... 215/252

3,994,409 11/1976 Nightengale, Jr. ..... 215/258 X

*Primary Examiner*—Steven M. Pollard

*Attorney, Agent, or Firm*—Charles E. Brown

[57] ABSTRACT

A closure for a container which includes a cap portion having a snap-on or friction fit with the neck finish and wherein the cap portion remains tethered to the container by way of a tethering strap extending between the cap portion and an anchoring band permanently affixed to the container neck finish. The tethering strap and the anchoring band are part of an extension of the skirt of the closure cap with the tethering strap being defined by a continuous weakening line of which portions must be ruptured in order to release the cap portion and to define the tethering strap. The rupturing of these portions gives indication of tampering.

5 Claims, 6 Drawing Figures

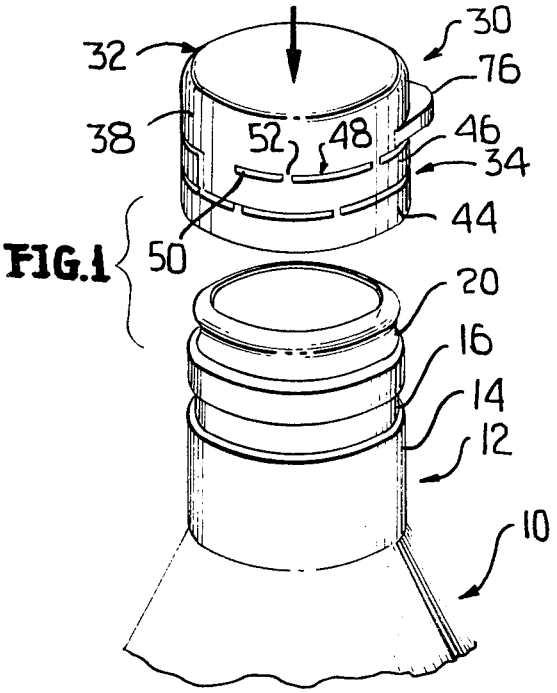
FIG.1
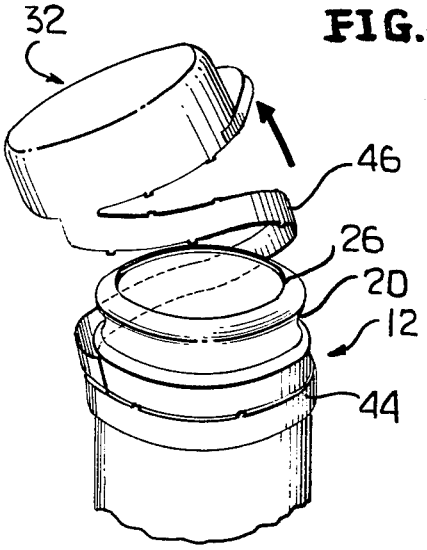
FIG.4
FIG.2
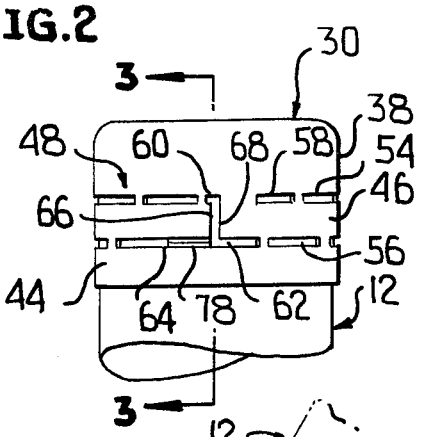
FIG.3
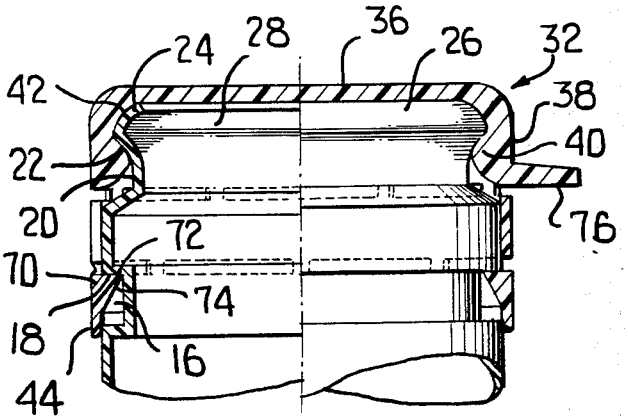
FIG.5
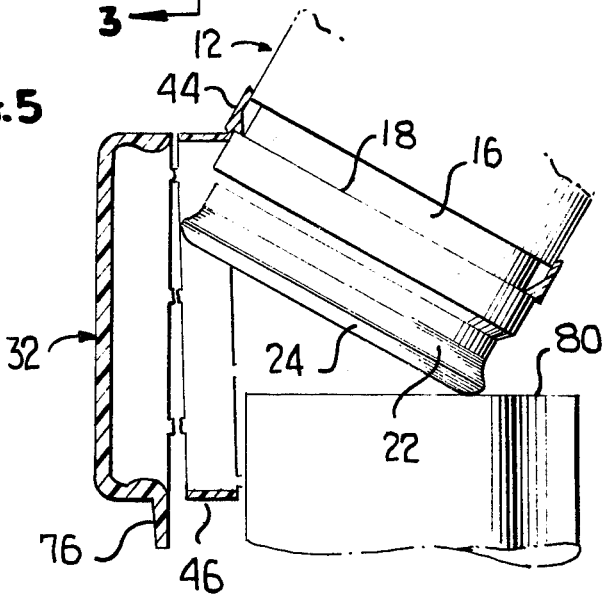
FIG.6
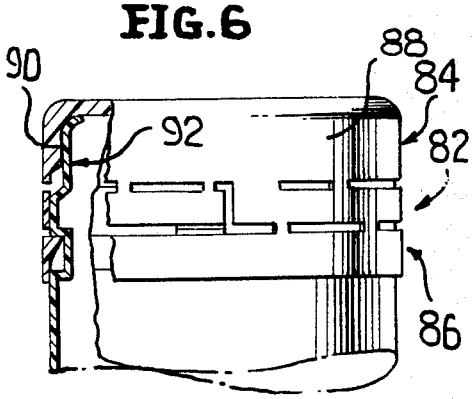

SNAP-ON CAP WITH TETHERING STRAP

This invention relates in general to new and useful improvements in closures for containers, and more particularly to a closure which has formed as part thereof a tethering strap and anchoring band with the tethering strap being integrally formed together with the anchoring band as an extension of the skirt of a cap portion of the closure.

Most particularly, there is provided a closure which is anti-littering in that it is permanently attached to an associated container by way of an anchoring band and wherein a cap portion of the closure is readily removable from the container and displaced relative to the mouth of the container so as to permit the product of the container to be poured therefrom while the cap portion remains attached to the container by means of the tethering strap.

This invention in particular relates to a closure of the type including a friction fit or snap-on type cap which may be axially removed from a container neck finish, but which remains tethered to the container so that it may remain permanently attached to the container at all times.

A particular feature of the closure is the manner in which the tethering strap is formed and also in the manner in which the tethering strap is hingedly connected to the anchoring band.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is an exploded top perspective view of a container upper portion and a closure therefor formed in accordance with this invention.

FIG. 2 is a fragmentary elevational view of an upper part of the container of FIG. 1 with the closure applied thereto.

FIG. 3 is an enlarged fragmentary vertical sectional view taken generally along the line 3—3 of FIG. 2, and shows specifically the construction of the closure and its relationship to the container neck finish.

FIG. 4 is a fragmentary top perspective view showing the cap portion of the closure removed from the container.

FIG. 5 is a schematic perspective view showing the manner in which the contents of the container may be poured therefrom while the closure cap remains tethered thereto.

FIG. 6 is an enlarged fragmentary elevational view with parts broken away and shown in section of a slightly modified form of closure and container neck finish.

Referring now to the drawings in detail, it will be seen that there is illustrated a conventional type of container 10 having a neck finish generally identified by the numeral 12. The neck finish 12 is generally cylindrical and includes an enlarged lower portion 14 which has formed in the upper part thereof an annular groove 16 with the upper surface of the groove being in the form of a downwardly directed locking shoulder 18.

Above the cylindrical lower portion 14, the neck finish 12 is provided with an undercut 20 which defines a retaining surface 22.

The neck finish terminates at the upper end thereof in a radially inwardly directed flange 24 of which the upper surface is a sealing surface 26. The flange 24 defines an open mouth 28 for the dispensing of a product from the container 10.

In accordance with this invention, there is provided a closure generally identified by the numeral 30. The closure 30 includes a cap portion 32 and a tethering portion 34. The cap 32 includes an end panel 36 and a depending skirt 38. The interior of the skirt 38 is configurated to define a retaining rib 40 which engages in the undercut beneath the retaining surface 22 to hold the cap portion 32 securely in place as shown in FIG. 3. Further, the cap portion 32 has an inner sealing surface 42 for sealing engagement with the sealing surface 26.

The tethering portion 34 is integrally formed as an extension of the skirt 38 and includes a lower anchoring band 44. Intermediate the anchoring band 44 and the lower edge of the skirt 38 there is a tethering strap 46. The tethering strap 46 is initially cylindrical in outline and integral with adjacent parts of the closure 30.

The tethering strap 46 is defined by a continuous line of weakening 48 which is preferably in the form of elongated openings 50 having intermediate bridges 52 separating the openings 50 at intervals. The weakening line 48 lies primarily in two planes and includes two portions, portion 54 which is positioned between the skirt 38 and the tethering strap 46, and portion 56 which is positioned between the tethering strap 46 and the anchoring band 44. The portion 54 has a starting end 58 and a terminal end 60, while the portion 56 has a starting end 62 and a terminal end 64.

The weakening line 48 also includes an intermediate portion 66 which extends between the ends 60 and 62.

In the preferred embodiment of the invention, the intermediate portion 66 is defined by an open space which is a central part of a generally Z-shaped open space 68 which includes the terminal end 60 and the starting end 62.

As will be best seen from FIG. 3, the anchoring band 44 has formed on the inner surface thereof a locking rib 70. The locking rib 70 has an upper surface defining a locking shoulder 72 and a sloping lower surface 74 which constitutes a camming surface. The locking rib 70 is so positioned relative to the groove 16 that when the closure 30 is applied the shoulder 72 will be positioned for movement into the groove 16 below the locking shoulder 18.

In order to facilitate the removal of the cap portion 32, the cap portion 32 is provided with a lifting tab or flange 76 which is generally diametrically opposite the intermediate weakening line portion 66. The closure 30 will be applied to the neck finish 12 in a press-on manner and when it is desired to open the container 10, the cap portion 32 is lifted by means of the lifting flange 76 so as to tilt the cap portion 32 and effect gradual removal thereof. This will result in the gradual rupture of the weakening line 48 so that as the cap portion 32 is being removed, the bridges 52 are progressively broken. As the bridges are broken, they become tamper indicating means. Eventually the weakening line 48 is ruptured for the full length thereof and the tethering strap 46 is fully defined.

At this time it is pointed out that in order that the lower end of the tethering strap 46 may hinge relative to the anchoring band 44, between the terminal end 64 and the intermediate weakening line portion 68 there is a hinge 78 formed by a weakening area which forms generally a continuation of the weakening line 48 and which permits the tethering strap 46 to hinge relative to the anchoring band 44 so that the cap portion 32 may be displaced to one side of the neck finish 12 so that the contents of the container 10 may be poured therefrom. In FIG. 5 there is a typical illustration of the manner in which the contents of a container, such as the container 10, may be poured into a receiving pipe 80, such as pouring oil into an oil filler tube of an engine.

In FIG. 6 there is illustrated a modified form of closure generally identified by the numeral 82 and including a cap portion 84 and a tethering portion 86. The closure 82 differs from the closure 30 only in that in lieu of the cap portion 84 being of the snap-on type, the inner surface of a skirt 88 thereof is cylindrical and has a friction fit with a cylindrical outer surface portion 90 of the upper part of the container neck finish, which modified neck finish is generally identified by the numeral 92. The skirt 88 of the cap portion 84 will be provided with a lift-off flange (not shown) such as the flange 76 of the closure 30.

It is to be understood that the closure 82 will function in the same manner as the closure 30, the only difference being the manner in which the cap portion thereof is retained on the container neck finish.

Although only two preferred embodiments of the clsoure formed in accordance with this invention have been specifically illustrated and described, it is to be understood that other minor variations may be made in the closure without departing from the spirit and scope of the invention as defined by the appended claims.

I claim:

1. A tethered closure comprising a cap portion and a tethering portion, said cap portion including an end panel and an integral depending skirt, said tethering portion being in the form of an extension of said skirt and including a lower anchoring band, a weakening line in said skirt extension defining a tethering strap between said skirt and said anchoring band, opposite ends of said tethering strap being permanently attached to both said skirt and said anchoring band, said cap portion being of the lift-off type and having a lift flange disposed remote from the permanent connection between said skirt and said tethering strap, said weakening line including first and second portions lying in spaced parallel planes, and an intermediate portion extending between said planes, the connection between said tethering strap and said anchoring band being in the form of a hinge lying in that one of said parallel planes lying adjacent said anchoring band and being at one end of said weakening line, said hinge being formed by a weakening area.

2. A tethered closure according to claim 1 in combination with a container neck finish, and said cap portion having a friction fit with said neck finish.

3. A tethered closure according to claim 1 in combination with a container neck finish, and said cap portion having a snap fit with said neck finish.

4. A tethered closure according to claim 1 in combination with a container neck finish, and said cap portion having a snap fit with said neck finish, said neck finish having an undercut and said skirt having an internal retaining rib seated in said undercut.

5. A tethered closure according to claim 1 wherein said skirt has a radially inwardly directed retaining rib for releasable interlocking with a container, and said anchoring band has a radially inwardly directed permanent locking rib.

* * * * *